United States Patent [19]

Actor

[11] Patent Number: 4,901,639

[45] Date of Patent: Feb. 20, 1990

[54] APPARATUS FOR ADAPTING A SINGLE SHEET FEED OFFSET DUPLICATOR TO PRINT ON CONTINUOUS FORM PAPER

[76] Inventor: James M. Actor, 6557 E. Lookout Dr., Parker, Colo. 80134

[21] Appl. No.: 192,201

[22] Filed: May 10, 1988

[51] Int. Cl.[4] ..... B41F 7/04; B41F 13/02; B41L 21/80

[52] U.S. Cl. ..... 101/142; 101/228

[58] Field of Search ..... 101/228, 232, 219, 136, 101/138, 141, 142, 143, 144, 178, 176, 179, 180; 400/616.1, 616.2, 616.3; 226/74, 76

[56] References Cited

U.S. PATENT DOCUMENTS

| | | | |
|---|---|---|---|
| 3,049,276 | 8/1962 | Wilkins | 226/74 |
| 3,154,233 | 10/1964 | Hubbard | 226/9 |
| 3,209,973 | 10/1965 | Eichorn | 226/74 |
| 3,373,684 | 3/1968 | Fisher | 202/228 |
| 3,548,747 | 12/1970 | D'Amato | 101/153 |
| 3,825,162 | 7/1974 | Hubbard | 226/74 |
| 4,066,015 | 1/1978 | Polke | 101/228 |
| 4,129,239 | 12/1978 | Hubbard | 226/75 |
| 4,175,687 | 11/1979 | Kenworthy | 226/74 |
| 4,251,162 | 2/1981 | Kammerer et al. | 400/616.3 |
| 4,300,710 | 11/1981 | Du Bois | 226/74 |
| 4,326,618 | 4/1982 | Volpe | 193/17 |
| 4,414,896 | 11/1983 | Fischer | 101/211 |
| 4,423,677 | 1/1984 | Fischer | 101/232 |
| 4,563,102 | 1/1986 | Sanders, Jr. | 400/691 |
| 4,566,685 | 1/1986 | Irvine | 271/150 |
| 4,607,837 | 8/1986 | Pierce | 271/273 |
| 4,691,914 | 9/1987 | Lawrence | 271/297 |
| 4,696,229 | 9/1987 | Bezler | 101/177 |
| 4,747,347 | 5/1988 | McAnelly | 101/228 |

*Primary Examiner*—J. Reed Fisher

*Attorney, Agent, or Firm*—Dorr, Carson, Sloan & Peterson

[57] ABSTRACT

A mechanical apparatus for modifying an individual sheet feed offset duplicator to print impressions on continuous form pre-punched and perforated paper. A first tractor module is attached to the input of the duplicator for delivering the paper into the duplicator and an indexing mechanism is provided in the first tractor module for providing precise indexing to the paper as it is delivered into the duplicator. A device for adjusting the registration of the impression on the paper is provided in the first tractor module adjustment while the machine is operating. A rear tractor module is also connected at the output of the duplicator and engages the continuous form paper to maintain a predetermined amount of tautness on the paper by providing supplementary pulling on the paper while the paper is pulled through the duplicator.

15 Claims, 10 Drawing Sheets

Fig. 6
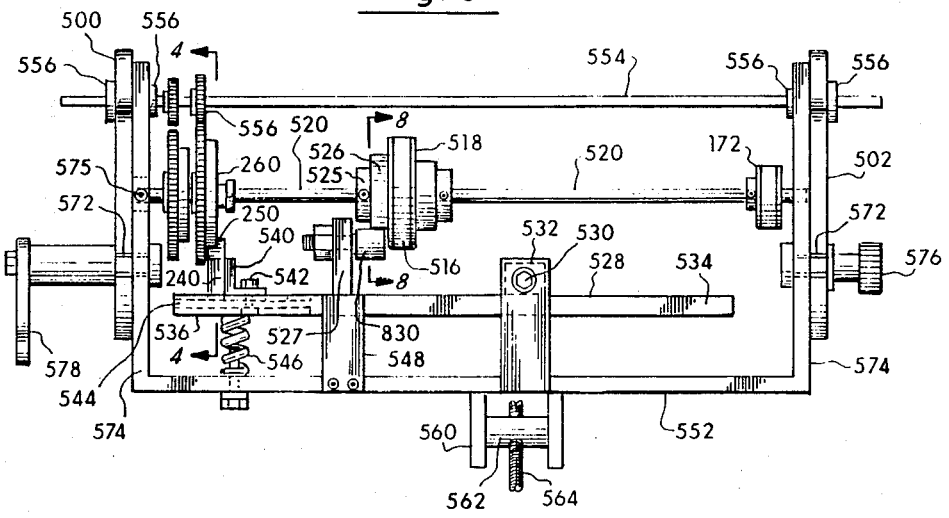
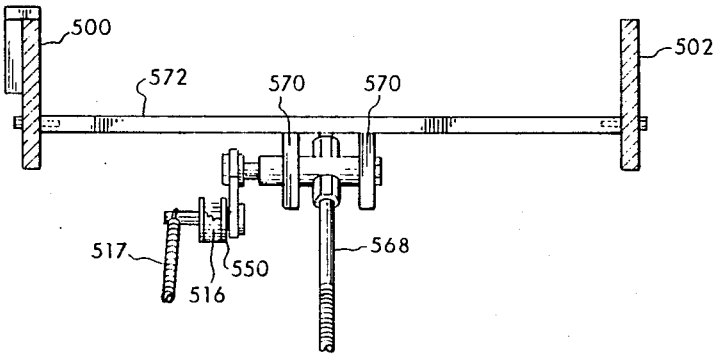
Fig. 7

APPARATUS FOR ADAPTING A SINGLE SHEET FEED OFFSET DUPLICATOR TO PRINT ON CONTINUOUS FORM PAPER

BACKGROUND OF THE INVENTION

1. Field of the Invention

The present invention relates to an apparatus for modifying a single sheet offset duplicator to print on pre-punched and perforated continuous form paper.

2. Statement of Problem

High quality, high speed printing can be achieved through use of a standard sheet feed offset duplicator. Two basic types of duplicators are available: chute delivery and chain delivery. Chain delivery duplicators comprise the vast majority of single sheet presses. Such offset duplicators can print stacks of individual sheets at speeds of 3,000 to 10,000 impressions per hour.

In comparison to single sheet presses, machines are available to provide continuous form printing having the ability to print impressions on prepunched and perforated sheets at generally a higher cost with lower speeds. To take advantage of the continuous form (i.e., a web of paper having punched margins and perforated between sheets) printing technology, however, a print shop owner is required to invest in a separate continuous form printer while maintaining and using his current inventory of offset duplicators Many smaller print shop owners cannot afford the capital investment or the physical area required to obtain continuous form printers while maintaining their cut sheet offset duplicators.

A need, therefore, exists in the marketplace for an apparatus to simply and quickly modify the existing and numerous chute and chain delivery offset duplicators in order to convert them into continuous form printers, and be able to take advantage of the lower cost of printing while running at full machine speed without a large capital outlay. A need further exists for this kit to be able to be readily attached to and removed from the conventional offset duplicator so that the operator can selectively use either stack sheet printing or continuous form printing based upon his printing needs. Furthermore, a need exists to improve the speed of creating impressions on a conventional offset duplicator adapted for printing on continuous form paper. Finally, such a conversion apparatus must maintain the registration full speed capabilities of the machine.

It is most desirable that said conversion be of a pure mechanical nature which is more easily understood and able to be repaired if necessary by the vast majority of printers in the field. Such a pure mechanical device has a far better chance of malfunction detection and correction by the average printer/owner than one of an electronic nature/basis. Electrically/electronically controlled devices have the inherent problem of too long a lead time to obtain parts, as well as so few, relative to our whole population, technicians capable of maintaining or repairing said devices.

One approach to modifying existing offset single sheet duplicators to print on continuous form prepunched and perforated paper is made by Sandco Inc. of 304 South Peoria, Tulsa, Oklahoma 74120-2620 as Model CFA (Continuous Forms Attachment). This attachment can be retrofitted to a number of different commercially available offset presses and requires two to four hours for the initial installation and, once initially installed, the press can be converted between printing or single sheets or printing on continuous form in about fifteen minutes.

Another approach is Model KCFF 2000 from Kinton, Inc., 2490 Kipling, Lakewood, Colo. 80215. This attachment is adaptable for use on most A. B. Dick and Ryobi duplicators, but is limited in speed to a maximum of 6000 impressions per hour. Also it has no means of clearing paper from the delivery end (exit) of the press so it subject to paper backing up except at slow speeds, especially if used on chain delivery presses. The initial installation is less than two hours and twelve to twenty minutes for changeover. The KCFF is not a pure mechanical approach and utilizes electric motors in its operation.

A search of issued patents uncovered the following:

| Inventor | U.S. Pat. No. | Issue Date |
|---|---|---|
| Bezler et al | 4,696,229 | Sept. 29, 1987 |
| Lawrence | 4,691,914 | Sept. 8, 1987 |
| Pierce | 4,607,837 | Aug. 26, 1986 |
| Irvine et al | 4,566,685 | Jan. 28, 1986 |
| Sanders, Jr. | 4,563,102 | Jan. 7, 1986 |
| Fischer | 4,423,677 | Jan. 3, 1984 |
| Fischer | 4,414,896 | Nov. 15, 1983 |
| Volpe | 4,326,618 | Apr. 27, 1982 |
| DuBois et al | 4,300,710 | Nov. 17, 1981 |
| Kenworthy | 4,175,687 | Nov. 27, 1979 |
| Hubbard | 4,129,239 | Dec. 12, 1978 |
| Polko | 4,066,015 | Jan. 3, 1978 |
| Hubbard | 3,825,162 | July 23, 1974 |
| D'Amato | 3,548,747 | Dec. 22, 1970 |
| Fisher | 3,373,684 | Mar. 19, 1968 |
| Eichorn | 3,209,973 | Oct. 5, 1965 |
| Hubbard et al | 3,154,233 | Oct. 27, 1964 |
| Wilkins | 3,049,276 | Aug. 14, 1962 |

The patent issued to Kenworthy relates to an apparatus for a continuous form printer that overcomes accumulation of errors through use of a rachet and pawl system to accurately index each sheet of the continuous forms. He accomplishes this by slightly overfeeding the continuous forms into the apparatus and then utilizing a spring motor to pull back the overfeed to just exactly the right index position when the feed drive is momentarily declutched. Kenworthy utilizes drive tractors at the output of his machine to pull the forms through the machine.

The patent to Fisher (3,373,684) pertains to a device for insuring accurate registration of the continuous form paper while being printed in standard multigraph printing machine. Fisher discloses a tractor mechanism located at the input to the machine. The drum and pressure roller of the multigraph machine pull the continuous form paper through the machine. Associated with the tractor is a mechanical locking apparatus utilizing a star wheel 35 to lockingly engage with a tooth 65. In operation, the tooth 65 locks with the star wheel 35 so that the continuous form being printed is properly registered before printing. The printing action then commences causing tooth 65 to raise thereby freeing its locked contact with the star wheel 35. The printing of the registered form commences and at the completion of the printing process, the tooth locks with the star wheel 35 to provide registration.

The patent issued to Hubbard ('233) discloses the use of front and rear feeds in a continuous form printer to provide correct registration of a continuous form with the printing mechanism. Hubbard advances the paper, a line at a time, through the printer, by using the tractors to feed the paper through the printer. The interconnections between the front and rear tractors are such to cause both tractors to operate in unison as well in order to provide sufficient longitudinal tension on the sheet material to avoid the separation of the several parts of the form at the print station and to prevent the development of air pockets between the layers of the form. Hubbard further utilizes a reluctance head and a magnetic brake to provide for precise indexing of the forms.

The patent issued to Wilkins also sets forth a high speed continuous form printer having a pair of synchronously moving tractors stationed on opposite sides of the print station. The tractors are used to drive the paper. In Wilkins, the paper tension can be adjusted by manipulating the belt linkage between the two sets of tractors.

The use of a back tractor to keep the paper properly tensioned between the front tractor and the printing mechanism is set forth by the two patents issued to Wilkins and Hubbard ('233). Both patents discuss the importance of synchronism between the front and rear tractor.

The patent to D'Amato adopts a rotary press such as a rotary intaglio press to print on continuous punched, but not perforated, web using a printing couple having a sprocket to feed the web intermittently and to release the web between successive feeding periods and a web-drawing means engaging the web on the other side of the machine for exerting a tensioning force on the web.

The patents issued to Fisher and Kenworthy generally show the concept of mechanical mechanisms providing indexing to insure exact registration for printing. Kenworthy utilizes a rachet wheel and pawl mechanical relationship to provide indexing and Fisher utilizes a star wheel and tooth. Fisher sets forth a modification to existing multigraphs and discloses the use of his tooth and star wheel mechanical relationship to index the form just prior to the printing by the drum.

Hubbard ('233) shows a combined system utilizing a reluctance indexing system combined with front and rear tractor drives. The Hubbard system provides for accurate registration and for the maintenance of desired tension while the sheet is being fed.

The remaining patents uncovered in the search are not as pertinent as the above discussed patents to the present invention.

Of all the patents, only the patent to Fisher converts a standard multigraph to print on continuous form paper. As will be found in the following, the present invention improves over the Fisher approach.

3. Solution to the Problem

The present invention offers a solution to the above problem by providing a simple mechanical conversion apparatus without the use of electric motors or control electronics for use on standard offset duplicators such as those manufactured by A. B. Dick Company of 5700 West Touhy Avenue, Chicago, Ill. 60648 and identified as Models 360, 9810 and look-a-likes. The present invention modifies the conventional offset duplicator by removing portions of the sheet delivery apparatus to the input of the duplicator for inputting the individual sheets into the offset duplicator and the chain or chute delivery located at the output of the machine. A continuous form feed apparatus is then mounted onto the offset duplicator and the modified duplicator becomes capable of printing at all speeds a duplicator can operate at such as 3000 to 10,000 impressions per hour. The novel index device incorporated into the delivery system of the present invention improves the registration of the impression on the paper over any conventional offset duplicator with a computer feeder on it especially at high speeds. It also allows registration to be adjusted while the machine is in operation. The conversion apparatus of the present invention is designed to be initially installed on an existing offset duplicator within a reasonable period of time such as ten to twenty minutes. After the initial installation, the machine can be converted between continuous form delivery and sheet delivery within five to ten minutes. The conversion apparatus of the present invention is adapted either to a chute or chain delivery feed which covers the vast majority of conventional offset duplicators in use. Being a pure mechanical device, maintenance and any repair is greatly enhanced by the average printer/owner.

SUMMARY OF THE INVENTION

The present invention provides a pure mechanical apparatus for modifying an individual sheet feed offset duplicator to print impressions on continuous form pre-punched and perforated paper. The conventional sheet feed is removed from the input of the duplicator as well as the conventional sheet delivery from the output, by replacing the standard impression blanket with an impression blanket modified by removing 3" of printing surface. The impression blanket and impression cylinder of the duplicator while printing the impressions on the continuous form paper pulls the paper through the duplicator.

The present invention provides for a first tractor module to be attached to the input of the duplicator for delivering the paper into the duplicator. An indexing mechanism is provided in the first tractor module for providing precise indexing to the paper as it is delivered into the duplicator. By changing certain gears and by adjusting the image position on the machine, the present invention is further able to feed through the duplicator different lengths of paper. A device for adjusting the registration of the impression on the paper is provided in the first tractor module and is operable while the machine is operating. A rear tractor module is connected at the output of the duplicator and engages the continuous form paper to maintain a predetermined amount of tautness on the paper by providing supplementary pulling on the paper while the paper is pulled through the duplicator by the impression blanket and impression cylinder. This maintains proper registration and prevents bunching up at the output of the machine at high speeds. The input module has an elongated tractor mechanism which generates power as the paper is pulled over the tractor. The power generated is delivered mechanically to the rear tractor to power the rear tractor to provide the necessary supplementary pulling.

DESCRIPTION OF THE DRAWING

FIG. 6 is a front planar view of the input module of FIG. 5;

FIG. 7 is a front planar view showing the lower rear portion of the input module of FIG. 5;

DESCRIPTION OF THE PREFERRED EMBODIMENT

1. General Discussion of Invention and Installation

Figure 1:
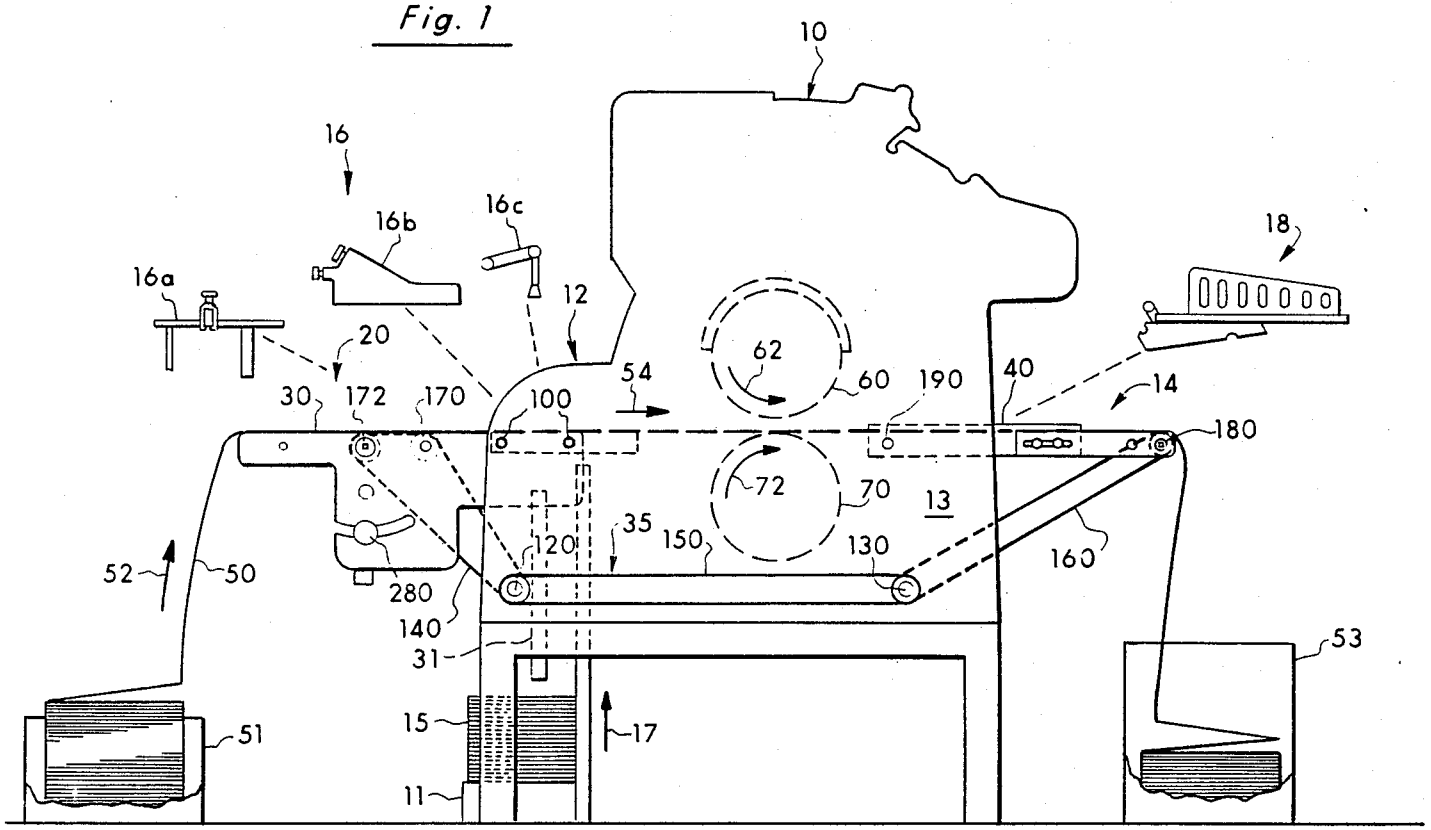
FIG. 1 is a side planar illustration showing the major components of the present invention being retrofitted to an existing individual sheet feed offset duplicator.

In FIG. 1, a conventional offset duplicator 10 is shown modified under the teachings of the present invention to carry the continuous form feed adaptor 20 of the present invention. The conventional sheet feed 16 (i.e., the paper guide 16*a*, the paper margin adjustments bar 16*b* and the sucker feet 16*c*) is removed from the input 12 of the machine 10 and the conventional sheet delivery 18 (usually a simple paper tray which is lifted out) is also removed from the output 14. Typically only a few bolts are encountered in the removal of the conventional sheet feed 16. The machine 10 also has an elevator 11 for elevating a stock of paper 15 in the direction of arrow 17. When the apparatus of the present invention is in operation, the elevator 11 is left at a bottom position.

The continuous form feed adaptor 20 of the present invention includes an input module 30 which is mounted to input 12, a rear tractor module 40 which is mounted to output 14, and a mechanical drive interconnection 35 between the input module 30 and the rear tractor module 40 which is mounted to the side 13 of the machine 10.

Continuous form pre-punched and perforated paper 50 is delivered from a source 51 in the direction of arrow 52 into the input module 30, through the machine as shown by arrow 54, between the impression blanket 60 and the impression cylinder 70 which jointly comprise the printing mechanism, through the rear tractor module 40, and downwardly in the direction of arrow 56 to be conventionally stacked at a destination 53.

The input module 30 mounts to the conventional offset duplicator 10 at points 100 utilizing existing mounting holes in the conventional offset duplicator 10. A stop bar 31 is positioned to stop upward movement of the paper 15 in the event that the operator of the machine accidentally activates the elevator switch. When the paper 15 hits the stop bar 31, the elevator 11 automatically stops thereby preventing damage to module 30. Likewise, the rear tractor module 40 mounts at locations 190 in the offset duplicator.

For example, to remove the sheet feed 16 from the conventional offset duplicator 10 such as the A. B. Dick Model 360, four bolts must be removed. Likewise, to install the front module 30 of the present invention, four bolts 100 must be utilized, as shown in FIG. 1. To install the rear module 40, the tray 18 is lifted out and the module 40 is placed over existing hinge points 190.

In addition, pulleys 120 and 130 are mounted onto the side 13 of the machine 10. These pulleys 120 and 130 are conventionally mounted and remain permanently installed to side 13 of the machine. Belts 140, 150 and 160 selectively engage pulleys 170, 172 and 120 on the input module 30 and pulleys 160 and 180 on the rear tractor module 40.

Hence, the initial installation of the system of the present invention requires that pulleys 120 and 130 be permanently mounted to the side 13 of the conventional offset duplicator 10. Then the input module 30 and the rear tractor module 40 can be selectively mounted and dismounted from the offset duplicator 10 and the offset duplicator can be utilized either to print individual sheets in a conventional fashion or continuous form sheets under the teachings of the present invention. As mentioned the initial installation of the conversion apparatus for the present invention can be accomplished between five to twenty minutes and the subsequent time to convert the machine between continuous form delivery and sheet delivery is five to ten minutes.

2. General Discussion of Operation

Figure 2:
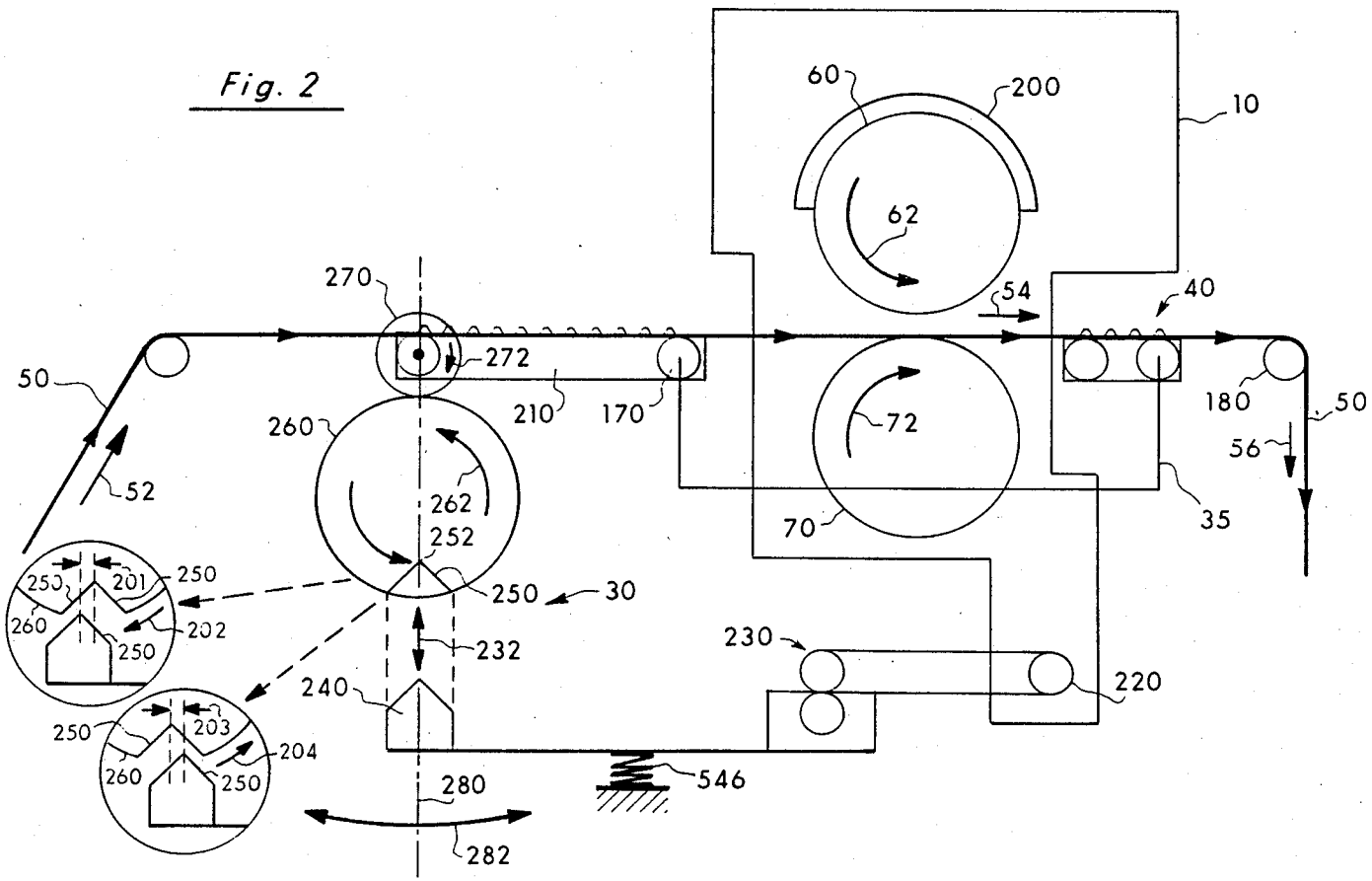
FIG. 2 is a schematic illustration of the functional operation of the present invention.

In FIG. 2, the general description of the operation of the present invention is schematically illustrated. When the blanket 200 of the impression blanket 60 rotates in the direction of arrow 62 and engages the paper 50, the impression cylinder then rotates in the direction of arrow 72 and creates an impression on paper 50. The engagement of the blanket 200 with the paper 50 and the impression cylinder 70 causes the paper to move in the direction of arrows 52, 54 and 56. This pulls the paper,. in one embodiment, approximately $10\frac{3}{4}$ inches through the machine 10.

During the time that the paper is being pulled through the machine by the printing mechanism (i.e., the impression blanket 60 and the impression cylinder 70), the pulled paper 50 also drives the front tractor 210 which in turn rotates pulley 170 to mechanically activate the mechanical drive 35 for delivering power to pulley 180 in the rear tractor module 40. This mechanical arrangement keeps the paper 50 taut (i.e., at a predetermined tension) while it is traveling through the machine between the front module 30 and the rear module 40. This tautness is important because the paper 50 can be of different fold firmness and quality and by keeping the paper taut between the front tractor 210 and the back tractor 40, registration, especially at high speeds, is maintained. The front module 30 by adding drag and the rear module 40 by providing supplementary pulling cooperate with the pulling of the paper through the machine by the printing mechanism to maintain this predetermined degree of tautness.

In addition, exact registration (i.e., location) of the impression on the paper from sheet to sheet is maintained by the following mechanical indexing structure. A conventional machine input gear 220 (paper feed roller gear) existing in the duplicator 10 is used as a power source for the indexing operation of the present invention. One rotation of the impression blanket 60 causes six rotations of gear 220. Gear 220 mechanically drives a cam mechanism 230 and selectively raises and lowers a V-shaped key 240 in the direction of arrow 232, once per revolution of the impression cylinder. The key 240 engages a V-shaped index 250 located on a timing gear 260. The V-shapes of the key 240 and the index 250 are such to mate together. The timing gear 260 is mechanically interconnected to gear 270 located on the front tractor 210.

As mentioned, when the impression blanket 60 rotates in the direction of arrow 62 it selectively engages the paper 50 to pull it through the front tractor 210. The pulling of the paper causes the gear 270 to rotate in the direction of arrow 272 which causes the timing gear 260 to rotate in the direction of arrow 262. Upon completion of printing the impression, the paper 50 rapidly decelerates and momentarily stops with the gear 260 index at the approximately six o'clock position although the impression blanket 60 continues to rotate. The paper will then rapidly accelerate and resume being pulled during the next revolution of the impression blanket 60.

While the paper is being pulled, the key 240 does not engage the index 250 and is held in a down position by the cam 230. However, upon completion of pulling the paper (i.e., upon completion of printing an impression), the index 250 is in the orientation shown in FIG. 2 and the key 240 is forcefully driven by spring 546 to engage the index 250 which causes the paper 50 on the front tractor 210 to be mechanically and precisely registered in the system 20. Hence, if the paper 50 traveled too far forward during the printing process (i.e., overshoots as shown by arrows 201), then the key 240 forces the gear 260 in the direction of arrow 202 which causes the tractor 210 to pull the paper 50 slightly back from machine 10 so that the key 240 seats in the index 250 at the index point 252. If the paper 50 did not travel forwardly far enough (i.e., undershoots as shown by arrows 203) then the key 240 forces the gear 260 in the direction of arrow 204 which causes the tractor 210 to push the paper 50 slightly toward the machine 10 so that the key 240 rests in the index 250 at the index point 252. Hence, upon completion of one impression, the key 240 and the index 250 mechanically engages to properly position the paper in the system and to maintain precise registration.

As will be further explained, a mechanical registration adjustor 280 can be utilized to adjust the timing gear 260 and the key 240 about gear 270 to provide for relocation of registration of the impression on the paper. Should the operator desire to move the location of the impression on the paper, the mechanism 280 can be adjusted in the direction of arrow 282.

Figure 3:
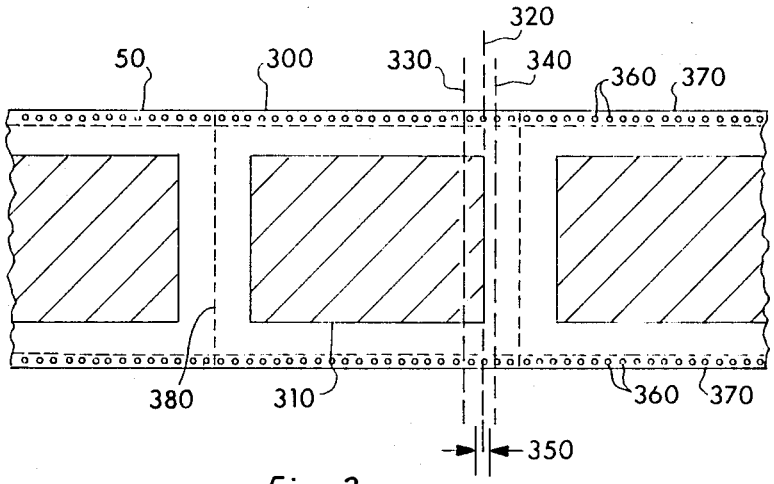
FIG. 3 is an illustration showing the registration of an image on a sheet of continuous form paper.
Figure 4:
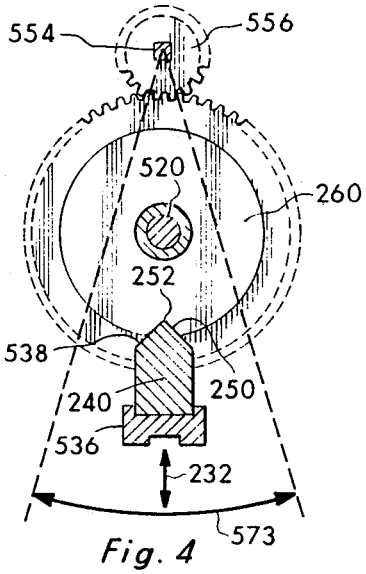
FIG. 4 is an illustration showing the indexing mechanism of the present invention.

FIG. 3 sets forth the top planar view of a page 300 of the continuous form paper or web 50 having margins 370 with punched holes 360 in which an impression 310 is printed thereon by the press 10 of the present invention. The impression 310 is registered at location 320 which is the desired location for the impression to be registered. However, by manipulation of the mechanical registration adjustor 280, the registration can be at any suitable location such as 330 or 340 on the page. Hence, the user of the present invention, without interrupting the printing process of the invention, can selectively change the registration of the image 310 on the page 300 through adjustment of mechanism 280. The registration, under the preferred embodiment of the present invention, can be varied in a range of one-half inch. Once a desired location for registration such as 320 in FIG. 3 is set, the key 240 and the timing gear 260 cooperate, as shown in FIG. 4, in a locked position, to accurately position the registration of the image at location 320 when key 240 seats into index 250 at index point 252.

As mentioned, should the paper have a slight overshoot 201 or a slight undershoot 203, and as also indicated by arrows 350 of FIG. 3, the key 240 seats in the index 250 at the index point 252 to properly align the paper 50 with respect to the machine to accurately and precisely obtain the registration set at location 320. The tolerance 350 is overcome under the teachings of the present invention by the wedge shape of the key 240 precisely orienting on the index point 252 of the index 250 in gear 260.

As can be witnessed in FIGS. 1 and 2, and under the teachings of the present invention, a conventional offset duplicator 10 can be easily modified to print on continuous form punched and perforated paper. In addition, the apparatus of the present invention allows for selective adjustment or change in the location of registration of the impression on the paper through use of mechanism 280 either while the machine is operating or while it is idle. Finally, through use of a unique timing gear mechanism, should any overshoot or undershoot of the paper occur after being pulled, especially at high printing speeds, the timing gear 260 in cooperation with the key 240 precisely aligns the paper in the printer 10 to obtain accurate registration.

The registration on the modified machine of the present invention is more accurate at full machine speed (i.e., 9000–10,000 impressions per hour) than an offset duplicator adapted for continuous form paper running at 5000 impressions per hour. For example, a normal run speed for a modified continuous paper offset duplicator is 5000 impressions per hour. Typical variations of the registration of the image occurred within 1/6 inch of the desired registration point. The present invention obtains registration within 1/16 inch at a speed of 9000 impressions per hour and less than 1/64 inch at a speed of 7000 impressions per hour or less.

The details of the mechanical structure implementing the above features will now be discussed.

3. Details of the Input Module 20

Figure 5:
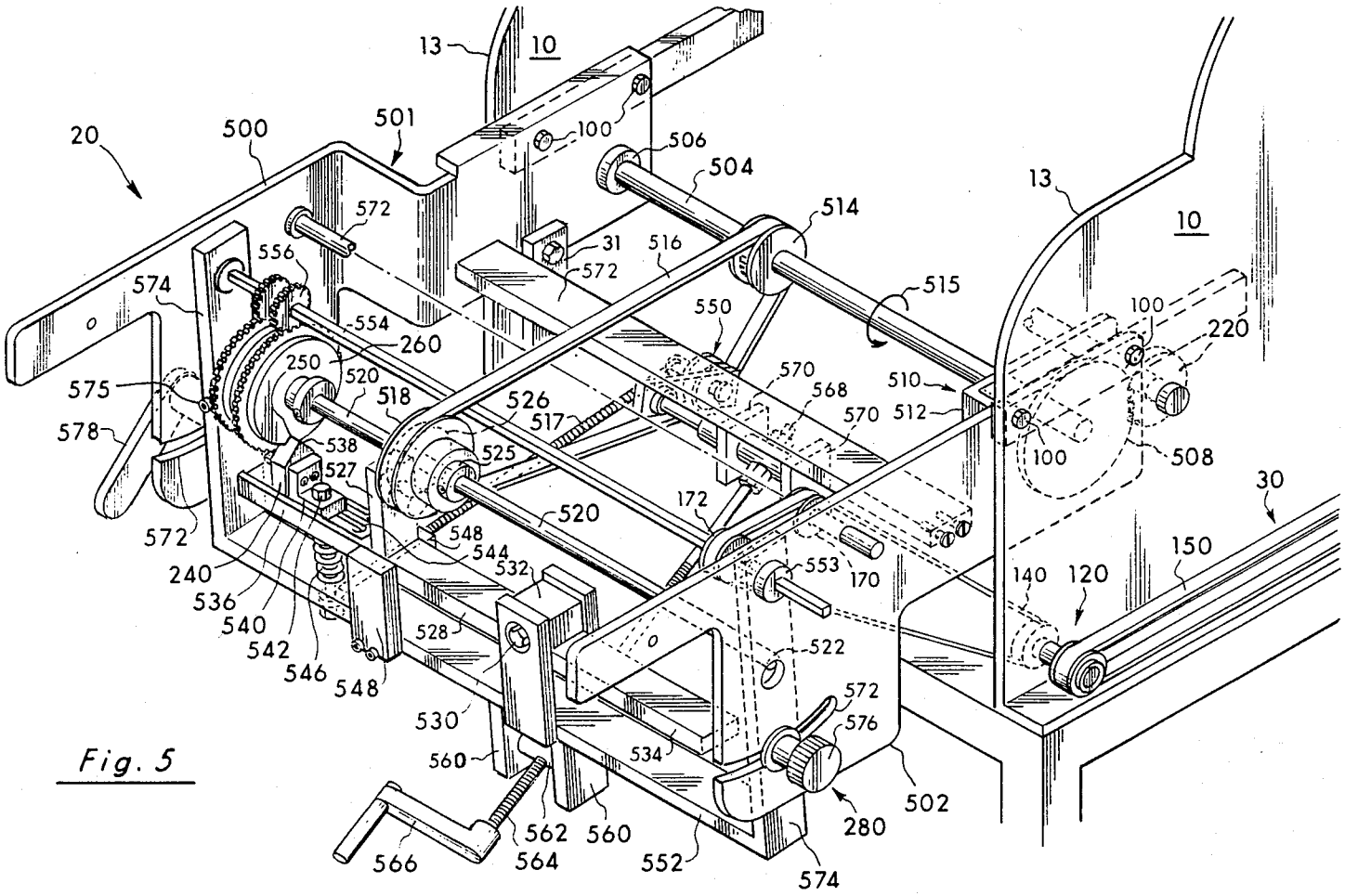
FIG. 5 is a perspective view of the mechanical components of the input module as mounted to a conventional offset duplicator.

In FIG. 5 the arrangement of the mechanical construction for the input module 20 of the present invention is set forth. The input module 20 includes two opposing mounting brackets 500 and 502 which are mounted to the sides 13 of the offset duplicator 10. The brackets 500 and 502 are mounted by four bolts with two bolts 100 holding an individual bracket onto the sidewall 13. This arrangement firmly engages the input module 20 to the duplicator 10.

The brackets 500 and 502 are of the design and configuration shown but may be of other suitable shape and configurations. Located between brackets 500 and 502 is a rear axle 504 which engages a bearing 506 in bracket 500 at one end and which is connected to gear 508 at the other end. Axle 504 has a corresponding bearing 510 located in housing 512. Gear 508 is driven by the internal gear 220 which is a conventional part of duplicator 10, as discussed above.

Gear 220 conventionally exists in the offset printer 10 and is generally known as the paper feed roller gear. Disposed on the axle 504 is a pulley 514 which engages belt 516. Belt 516 engages a pulley 518 which turns on axle 520. Axle 520 is attached to the brackets 500 and 502 and does not turn. As gear 220 turns and causes drive gear 508 to turn, pulley 514 turns causing belt 516 to turn pulley 518 around shaft 520. Axle 504 turns in the direction of arrow 515.

Figure 8:
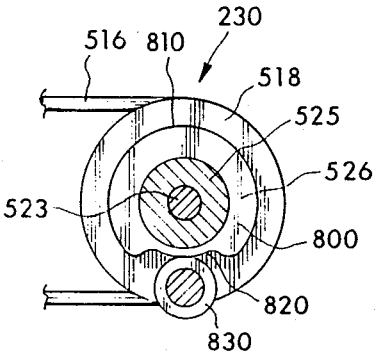
FIG. 8 is a planar view of the cam and shaft of the present invention.

As shown in FIGS. 5, 6, and 8, pulley 518 is part of the cam arrangement 230 previously discussed. It is important to observe that as pulley 518 turns on fixed shaft 520, timing gear 260 independently turns on shaft 520. As will be explained, as pulley 518 turns, the cam 526 which is attached to it turns causing the key 240 to move in the direction of arrow 232 as shown in FIGS. 2 and 4. Hence, six revolutions of gear 220 which corresponds to one revolution of the impression blanket 60 causes the pulley 518 to undergo one revolution. The turning of pulley 518 causes the cam arrangement 230 to move the key 240 up to selectively engage the timing gear 260 with every revolution. As shown in FIG. 8, the cam arrangement 230 includes a cam 800 having a first circular portion 810 and a second circular portion 820 of greater diameter which abuts a fixed roller bearing 830.

As the cam 800 turns, the shaft 830 which is affixed to a pedestal 527 on lever 528 moves up or down in the direction of arrow 232. Lever 528 is mounted to pivot about bolt 530. Lever 528 has an upstanding portion 532 which engages bolt 530 having a bearing therebetween. The lever 528 extends outwardly at end 534 and has the key 240 mounted at end 536. As shown, the key 240 is a machined element having a wedge-shaped upper surface 538 and is mounted onto end 536 of the lever 528. A bracket 540 is attached to the key 240 and is bolted by means of bolt 542 to engage a slot 544. Adjustment of the bolt 542 allows the key 240 which is integrally attached to the angle bracket 540 to be selectively moved along the longitudinal direction of the lever 528. This feature will be discussed later. Underneath the end 536 of lever 528 is a spring 546 which biases the key 240 in an upward direction. The spring 546 allows a "snap-action" effect when locking into the index 250 of the timing gear 260 and forces the tractor 210 to compensate for overshoot and undershoot of the paper. Lever 528 is positioned between two upstanding and opposing guides 548.

Additionally, the belt 516 engages an idler pulley 550 to maintain proper tension in belt 516. Idler pulley is biased by spring 517.

The above described mechanical mechanism provides the timing for proper registration 320 of the impression 310 on the page 300 as shown in FIG. 3. As the internal and conventional gear 220 revolves, with six revolutions corresponding to one revolution of the impression blanket 60, the cam 800 causes the lever to selectively engage the timing gear 260 to provide for precise registration of the paper. As explained, the timing gear 260 is turned by means of the paper being pulled through the machine by the cooperation of the impression blanket 60 and the impression cylinder 70. Hence, as gear 260 turns, it does so independently of the action on pulley 518. As the paper is pulled through by the printing mechanism 60, 70, shaft 520 is fixed and does not turn. It is clear that under ideal situations timing gear 260 and pulley 526 should be turning at the same rate. Hence, when the timing gear 260 turns around so that the key 240 is ready to lock into place, the timing gear index 250 and the key 240 are ready to function in a locking engagement. In the event that the timing gear 260 has been pulled too far or not far enough as indicated by arrows 350 in FIG. 3, the spring biased key 240 locks into the index 250 and forcefully re-positions the gear 260 to precisely the same index point 252 on gear 260 which corresponds to the desired registration line 320. This compensates for overshoot or undershoot of the paper.

It is to be expressly understood that while a preferred mechanical embodiment of the input module 30 has been set forth, variations as to the design and placement of the individual components could be made and still fall within the teachings of the present invention.

4. Adjustment of Registration Mechanism 280

Also shown in FIGS. 4, 5, 6 and 7 is the adjustment of the registration mechanism 280 which includes a pivotal frame 552 mounted between outer brackets 500 and 502. The pivotal frame 552 is rectangular in shape and pivots about axle 554. Axle 554 is mounted to the frame 552 through bearings 553 on both sides. Also mounted on axle 554 is at least one tractor gear 556. The tractor gear 556 is driven by the front tractor feed 210 as will be described subsequently. Also mounted on axle 554 is a pulley 172 which engages belt 140. An idler pulley 170 keeps the belt 140 properly tensioned. An axle 572 is provided between opposing brackets 500 and 502 to selectively engage pulley 170.

Hence, as gear 556 is turned through action of the paper 50 being pulled by the printing mechanism 60, 70 causing axle 554 to turn, pulley 172 turns causing belt 140 to drive the rear tractor module 40 as previously discussed.

Mounted on the frame 552 is a bracket 560 which has a worm gear 562 disposed there between. A threaded shaft 564 having a hand crank 566 disposed on the end thereof is disposed through the worm gear 562. The other end 568 of the shaft 564 is pivotally connected between a pair of brackets 570 as shown in FIG. 7. The pair of brackets 570 are attached to bar 572 which is disposed between and connected with opposing brackets 500 and 502.

Each frame 500 and 502 has a formed arcuate slot 572 which forms a circular arc around axle 554. Connected on each leg 574 of the frame 552 is a tightening means 576 and 578. Loosening the means 576 and 578 enables the user of the present invention to grasp the handle to loosen the frame 552 and pivot the entire frame 552 about gear 556 by turning the hand crank 566. This can occur even while the machine is in full operation. Moving the frame 552 closer to bar 572 causes the gear 260 to rotate about gear 556 and thereby changes the placement of the image 310 on the paper 300 as discussed for FIG. 3. It is clear that as the frame swings inwardly or outwardly from bar 572 through a desired angle 573 as shown in FIG. 4 that the belt 516 must have its tension maintained and this is accomplished by idler wheel 550 as previously discussed. The movement of the frame 552 through angle 573 varies the registration 320 of the impression on the page 300 by advancing the gear 556 either clockwise or counterclockwise.

In summary of this section, the frame 552 which carries the cam 230, the key 240, and the timing gear 260, as a unit, can be selectively adjusted about gear 556 to move the registration of the image 310 on the page 300. As such movement, in a direction perpendicular to the direction containing plates 500 and 502 occurs, belts 516 and 140 have their tension maintained through use of appropriate idler wheels 550 and 170. This adjustment may be done with the machine 10 idle or while printing. To make this adjustment while printing saves substantial time for the operator over the approach of starting and stopping the machine to make the adjustment.

Figure 15:
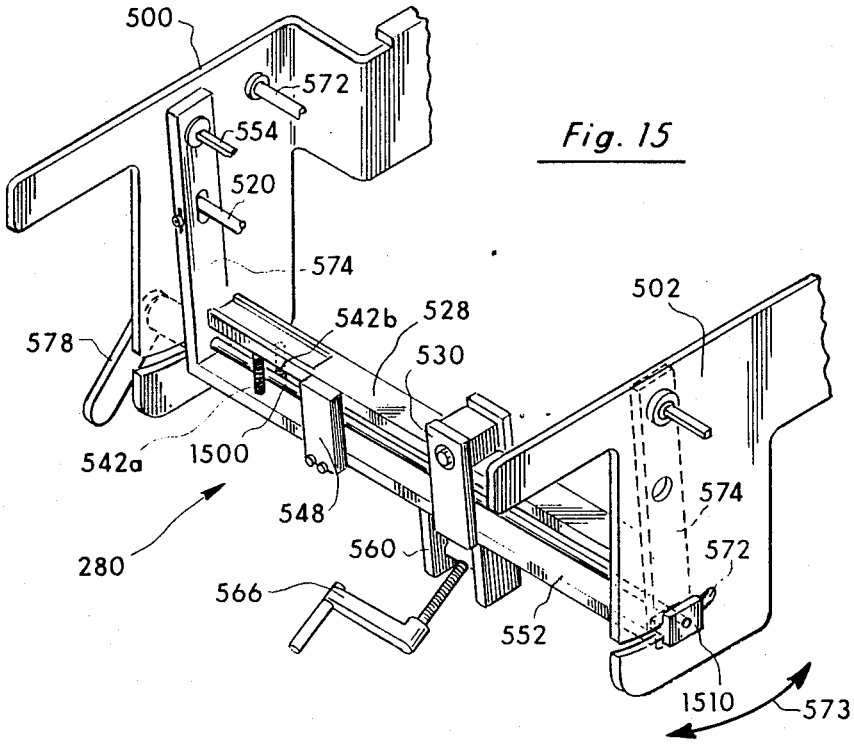
FIG. 15 sets forth the details of a second embodiment for the adjustment of registration mechanism of the present invention.

While a preferred embodiment of the registration mechanism 280 has been set forth above, it is to be expressly understood that variations as to the design and placement of the individual components could be made and stillfall within the teachings of the present invention For example, an alternate registration adjustment mechanism 280 is shown in FIG. 15. In this embodiment, a bar 1500 connects the handle 578 to the frame 552 through a T-nut 1510. In this embodiment, the bar 1500 is disposed between lever 528 and the bottom of the frame 552. The spring 542 must be bifurcated into two springs 542*a* and 542*b* to permit the passage of the bar 1500 in the center of the frame 552. In this embodiment, by simply turning the handle 578 a half turn, the T-nut 1510 quickly loosens and allows the frame 552 to pivot in slot 572 through the angle 573 when crank 566 is activated. This embodiment in comparison to the embodiment of FIG. 5 provides a much quicker release of the frame 552 from the side brackets 500 and 572.

It is to be expressly understood that the configuration of the support brackets 500 and 502 could be of any desired configuration. For example, in FIG. 5, bracket 500 goes through a bend 501 to provide a "gull-wing" appearance. To the contrary, bracket 502 is linear and does not undergo a bend. It is to be understood that both brackets 500 and 502 could have a gull-wing type bend 501 or that both sides could be linear or any combination thereof.

5. Forward Tractor Mechanisms

Figure 9:
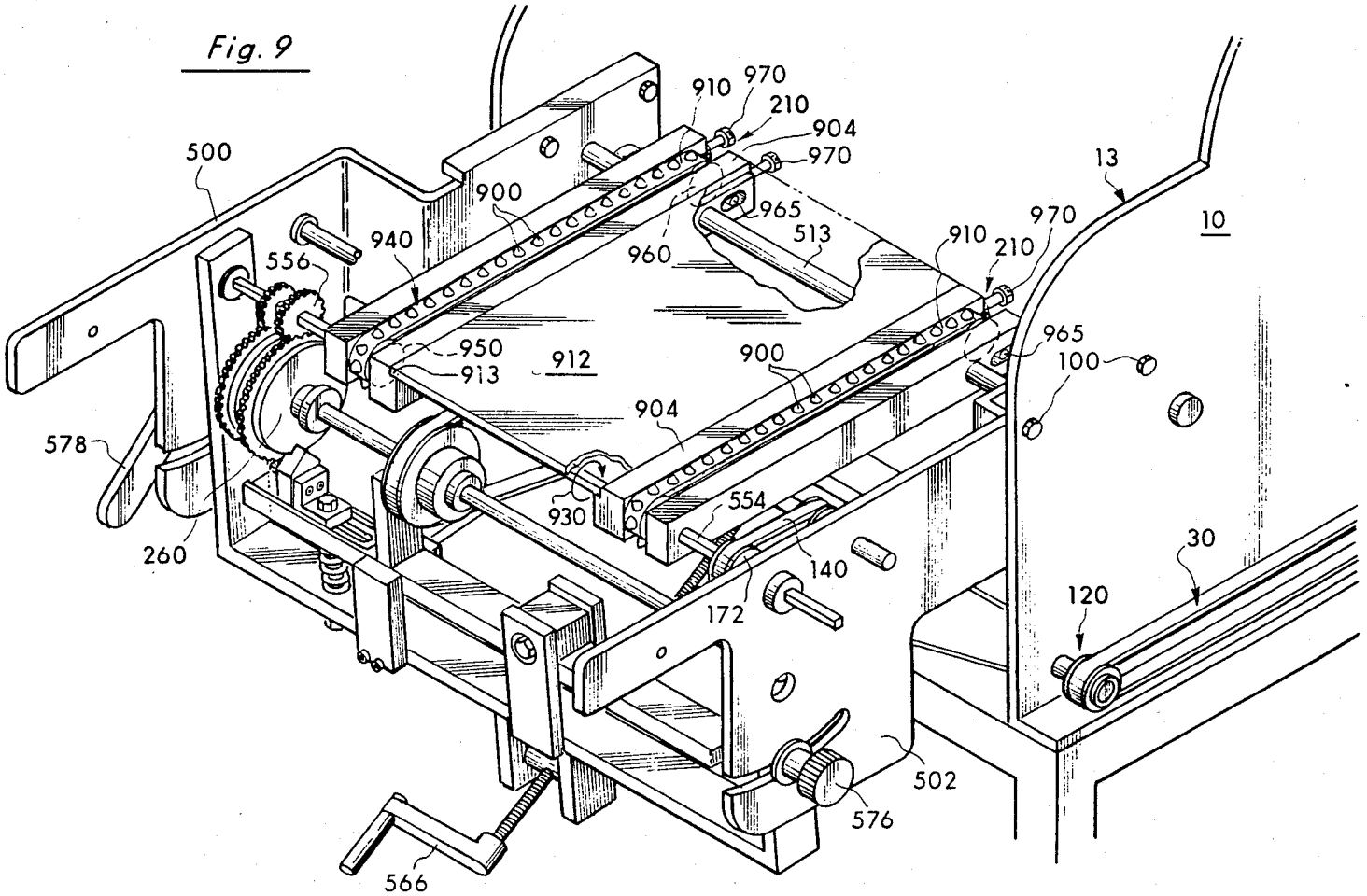
FIG. 9 is a perspective view of the input module illustrating the position of the tractors.
Figure 10:
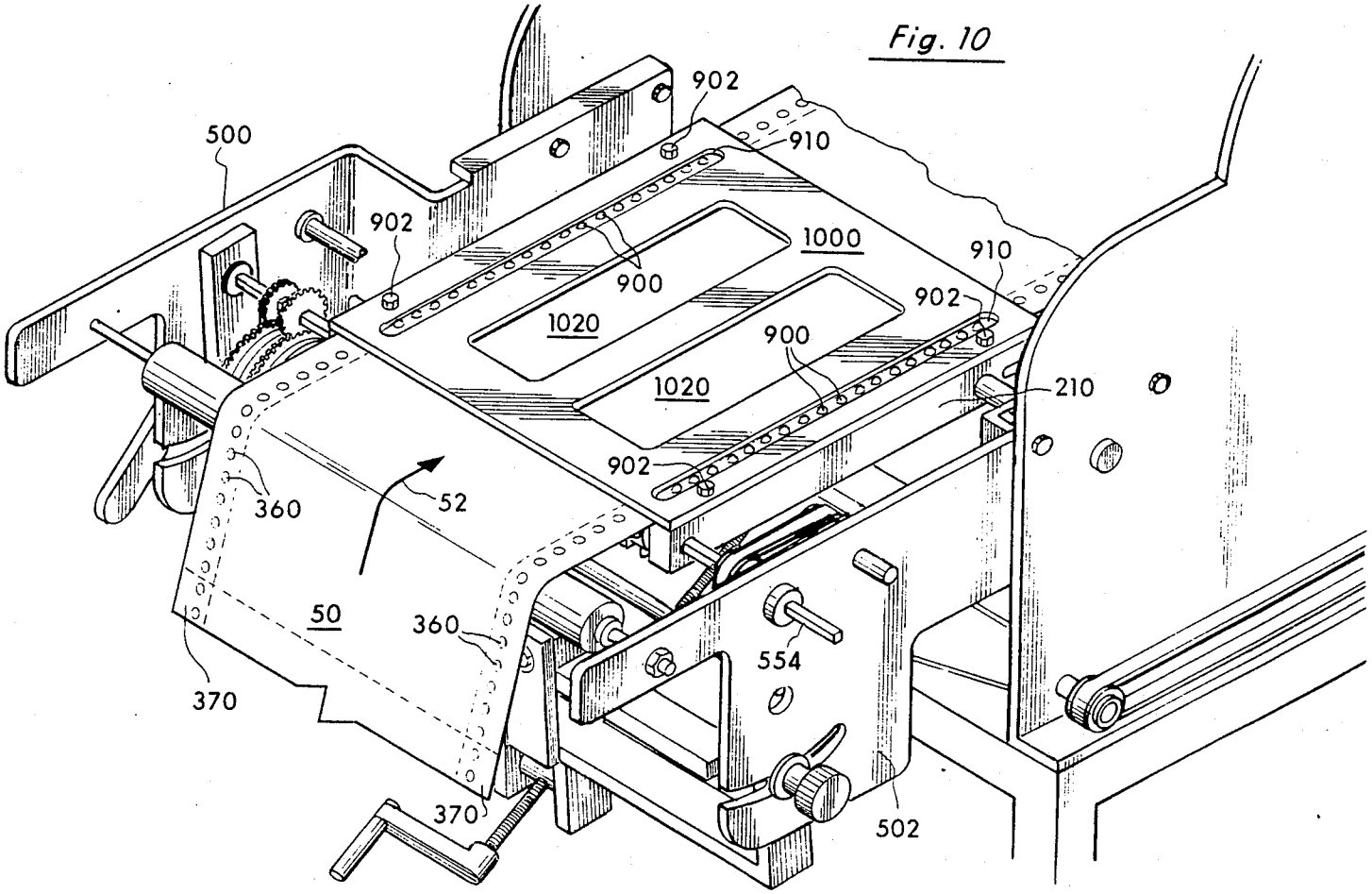
FIG. 10 is a perspective view of the input module illustrating the engagement of the continuous form paper with the module.

In FIGS. 9 and 10, the details of the forward tractors 210 are shown. The forward tractors 210 are mounted on axles 554 and 965. They are spaced in parallel relationship between brackets 500 and 502. Shaft 513 provides rear support to tractors 210. Each tractor 210 is elongated and is approximately twelve inches in length.

The length of the tractor is important to the teachings of this invention and must be substantially equal to the length of a page of the paper. The web 50 has to move from zero mph to about two mph in $\frac{1}{3}$ of a second. The drag of all attached mechanical mechanisms (i e., in the front module 30, the extension 35, and the rear module 40) must be borne by the holes 60 in the paper. By having 44 pins 900 in contact with the paper holes and by having the length of the rubber belting that hold the teeth in contact with the paper, this stress is distributed so that at high speed no damage occurs to the holes and the end product is usable/salable. This length is important because it permits, as shown in FIG. 10, a substantial longitudinal engagement with a page of the paper 50.

The punched holes 360 in the margins 370 of the paper are engaged by a plurality of spaced pins 900 mounted on a rubber track or belt 910. As shown in FIG. 9, a first rectangular flat plate 912 is placed between tractors 210 on lip 913 to support the web 50 as it travels over the tractors.

In FIG. 10, a second rectangular plate 1000 is shown placed over the tractors 210. This plate 1000 is secured by means of screws 902 to the upper surface 904 of the tractors 210. This rectangular plate 1000 serves as a guide for the paper 50 as it travels over the tractors 210. The plate 1000 forces the paper 50 against the belts 910 for positive engagement. Also this sandwiches the paper between plate 1000 and the rubber belt 910 holding the pins 900. This helps absorb the stress when the paper is pulled by the machine. An elongated slot 910 is provided in the rectangular guide 1000 over the engagement of the pins 900 with the punched holes 360 as shown in FIG. 10. Rectangular openings 1020 are also provided for enabling the operator to visually check the perforations 380 in the paper 50 in a predetermined position. This also helps for adjustment of the frame 552 when turning crank 566 to determine a change in registration position.

As mentioned and with reference back to FIGS. 1 and 2, the impression blanket 62 pulls the paper 50 forward in the direction of arrow 52 across the tractors 210. The pulling of the paper in the direction of arrow 52 causes the pins 900 to move and to drive the belt 910 which in turn causes axle 554 to turn in direction 930. The pins 900 on belt 910 ride in a defined slot 940 of the tractor 210 and engages a front gear 950 and a rear idler gear 960. Gear 950 lockingly engages axle 554 whereas gear 960 rides on a bearing surface around pin 965. Hence, as the belt 910 turns causing gears 950 and 960 to rotate, the rotation of gear 950 causes shaft 554 to turn in the direction of arrow 930 which causes gear 556 to rotate thereby causing timing gear 260 to rotate. The rotation of gear 260 occurs with respect to key 240 as previously discussed. At the same time, the rotation of axle 554 causes pulley 172 to rotate thereby causing belt 140 to drive pulley 120 and belt 30 which drives the rear tractor module 40 as previously discussed. The tension on belt 910 with respect to the tractor 210 can be changed by adjustment of screws 970.

As found in FIG. 10, as the paper 50 is pulled in the direction of arrow 52 by the printing mechanism internal to machine 10, the paper is firmly supported (underneath by plate 912 and above by plate 1000 as shown in FIG. 9) to positively engage the pins 900 of the two tractors 210. This positive engagement serves three important functions. First, the paper 50, as it is being pulled, serves as a source of generated power to drive belts 130, 150 and 160 to power the rear tractor module 40. The lengthy longitudinal engagement between the pins 900 and the punched holes 300 prevents tearing or laceration to the holes especially during the periods of high speed operation when extreme accelerations and decelerations occur as each impression is made. Second, the friction encountered to drive the rear tractor module creates a certain degree of drag on the web 50 as it is being pulled. This drag in cooperation with the supplemental pull of the rear tractor module 40 provides a predetermined degree of tautness for the paper between the input module 30 and the rear tractor module 40. Third, the lengthy longitudinal engagement provides positive engagement between the pins 900 and the holes 360 during the aforedescribed indexing process of overcoming overshoot or undershoot of the paper.

The key to high speed operation or medium speed operation on a chain delivery is to physically pull the paper away from the machine for restacking. Otherwise the paper is "pushing itself" and a log jam occurs. This is the key element of this invention and necessitates the large front tractor to drive the rear tractor as well as to protect the integrity of the paper holes at high speed. No other mentioned device in patents or on the market has addressed this problem with enough tractor pins 900 to run at full machine speed as accomplished by the present invention. It is to be expressly understood that variations to the above structure could be made and still be within the teachings of the present invention.

6. Adaption to Different Page Lengths

The present invention is capable of adapting to different page lengths between the perforations 380 of the continuous form paper 50.

Figure 11:
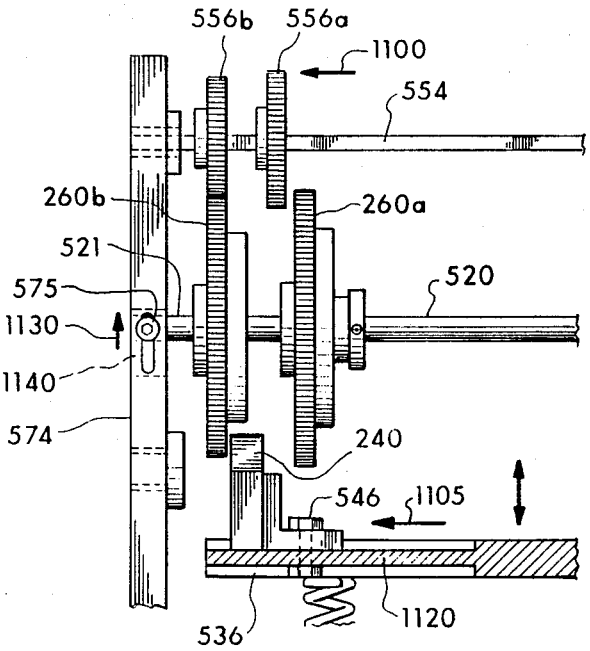
FIG. 11 is a front planar view of the multiple gear arrangement to provide indexing for different sized pages in the continuous form paper.

The details of how this is structurally accomplished, at least in one embodiment, is shown in FIG. 11. In FIG. 11, gear 556*a* is released from axle 554 and slid in the direction of arrow 1100. It is then retightened to axle 554 in a conventional fashion. This places it out of disengagement with gear 260*a*. Likewise, the key 240 is slid in the direction of arrow 1105 in slot 1120. When it is in position to engage the new gear 260*b*, it is tightened down in a conventional fashion by tightening nut 546. The last remaining adjustment pertains to the end 521 of axle 520. It must be moved upwardly in the direction of arrow 1130 in a slot 1140 and then affixed by means of screw 575, which is shown in FIGS. 5 and 6. This is required to maintain engagement between the different sized gears below. The system is now adapted to print impressions on different sized paper.

It is to be expressly understood that two or more gears 556*a* and 556*b* could be utilized on the upper axle 554 and that these gears could also be moved in the direction of arrow 1100 along axle 554 to selectively engage or disengage a plurality of gears 260*a* and 260*b*. Likewise, it is to be expressly understood that two or more gears could be positioned along axle 520 to engage the upper gears 556.

For example, by changing the gears 556 and 260, different lengths of pages can be fed through the press as follows:

| Length of Perforated Page | Gear 556 (Teeth) | Gear 260 (Teeth) |
|---|---|---|
| 11 Inches Standard | 32 | 88 |
| 12 Inches (or 4 up on 3" perforations) (or 3 up on 4" perforations) | 28 | 84 |
| 14 Inches (or 2 up on 7" perforations) | 24 | 84 |
| 6 Inches (or 2 up on 3" perforations) | 56 | 84 |
| 7 Inches (or 2 up on 3½" perforations) | 48 | 84 |

The present invention cuts three inches off of the impression blanket 200 which is normally seventeen inches. The resulting fourteen inch blanket can be conventionally oriented with the impression cylinder to print the paper lengths set forth above. The present invention, by printing two seven inch impressions at the same time produces an output which is double that of the Kinton KCFF attachment (which prints only up to twelve inches).

The simple gear adjustability arrangement of FIG. 11 can provide the operator of the present invention with significant versatility in handling different page lengths of the continuous form web. Furthermore, with the ability to adjust the registration of the image on the page through the angle 573 of FIG. 4, it can be readily appreciated that the operator of the present invention has substantial flexibility in meeting the individual needs of his customers.

It is to be expressly understood that different approaches to the gear arrangement of FIG. 11 could be designed to adapt the system of the present invention to handle different lengths of pages in the continuous web 50 and still fall within the teachings of the present invention.

7. Rear Tractor Module 40

Figure 12:
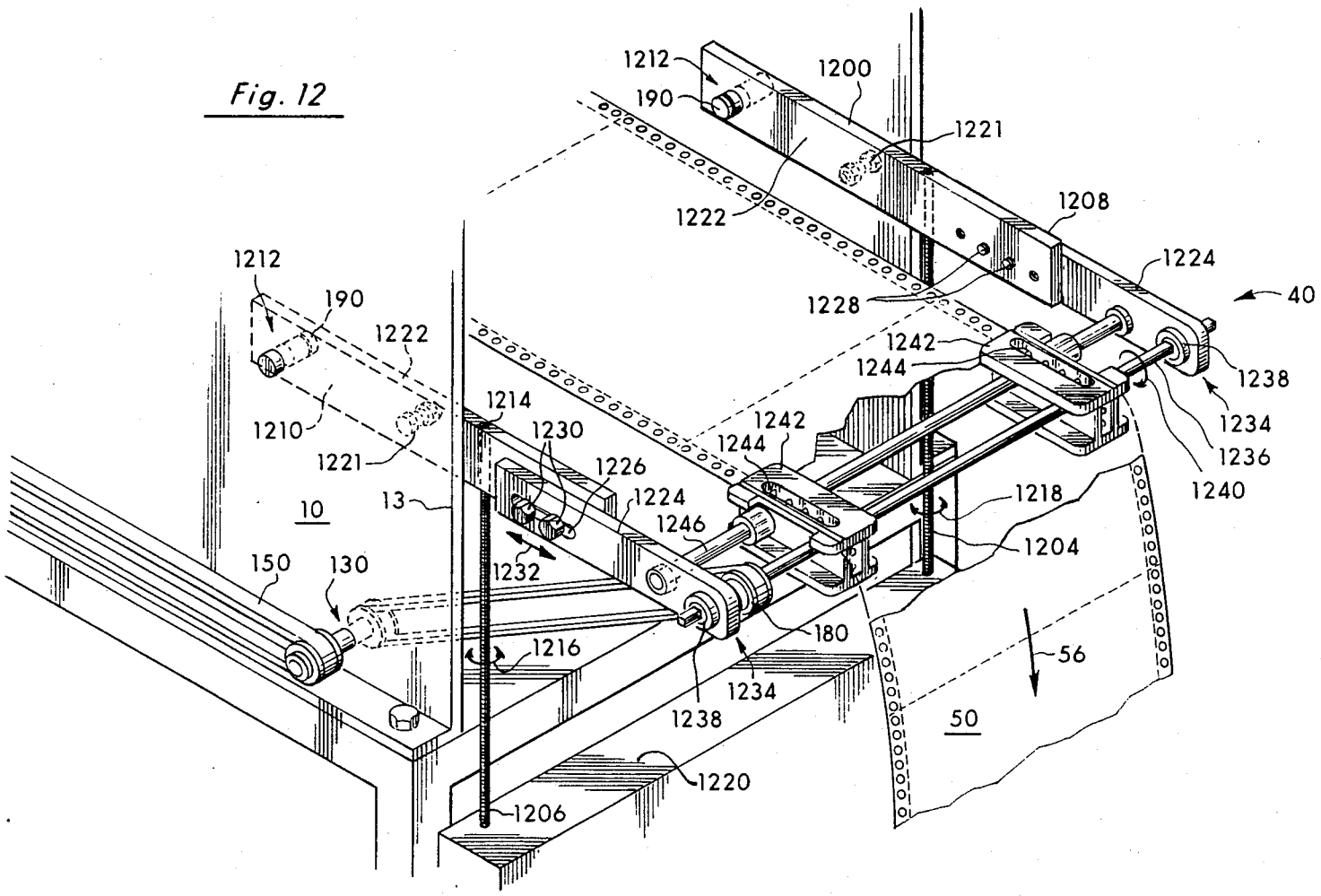
FIG. 12 sets forth the details of the rear tractor module of the present invention.

The rear tractor module 40 is shown in FIG. 12. The rear tractor module has two parallel bars 1200 and 1210 which have one end with a defined hole 1212 which slide over the hinge 190 as priorly discussed. Two vertical support posts 1204 and 1206 are used to support the bars 1200 and 1210 in a horizontal position with respect to machine 1210. Bars 1204 and 1206 threadedly engage bars 1200 at point 1208 and bar 1210 at point 1214. Bars 1204 and 1206 are threaded and can be turned in the direction as indicated by arrows 1216 and 1218 to selectively raise or lower the rear tractor module 40. After proper position is arrived at, a single bolt hole can be drilled (optional) on each side to hold bars 1200 and 1210 in that fixed position with a nut and bolt 1221. Thereafter remove posts 1204 and 1206. The bars 1204 and 1206 rest on a support 1220 which is part of the machine 10. Each bar 1200 and 1210 is split into a rear bar section 1222 and a forward bar section 1224. A slot 1226 is formed in each of the bars 1224 and a plurality of holes 1228 are formed in the bars 1222. Two bolts 1230 are used to affix the portion 1224 to the bar portion 1222 by engaging holes 1228 and tightening thereon. The bars may then be adjusted in the direction of arrow 1232 by loosening screws 1230 and making the proper adjustment. This allows the paper 50 as it is fed from the machine to positioned accordingly. Between the two bars 1200 and 1222 is disposed at end 1234 an axle 1236. This axle is supported in bearings 1238 and freely rotates. Hence, as pulley 180 is turned, the axle 1236 turns in the direction of arrow 1240 to provide a supplementary pull to the paper 50 to insure that the paper is delivered from the machine and to maintain the required degree of tautness as the paper is being printed. Tractors 1242 are positioned to engage the punched holes 360 of the paper 50. As axle 1236 rotates in the direction of arrow 1240, gears internal to the tractors 1242 cause teeth 1244 to pull the paper in the direction of arrow 56. Each tractor 1242 is also supported on a fixed or rigid axle 1246 which is affixed to bars 1200 and 1222 as shown in FIG. 12. A rear internal gear of each tractor 1242 rotates on a bearing surface on this axle 1246.

The rear tractor module 40 functions to clear the paper 50 from the output 14 especially at high speeds. This is especially true in chain delivery duplicators where the tractors significantly speed up restacking of the paper. The module 40 further prevents the paper 50 from being angled out from the machine. If the paper 50 were angled, then this would affect the side-to-side registration of the impression on the paper. The lengthy longitudinal engagement (i.e., the substantial length of a page) by the front tractor with the paper provides sufficient power to the rear tractor module 40 to accomplish these functions especially at high speed operation.

Figure 14:
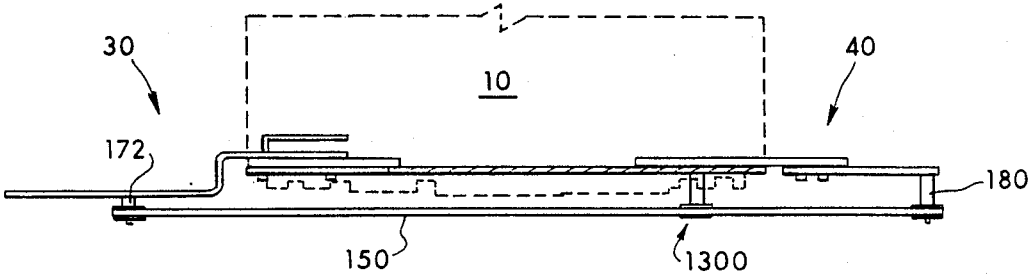
FIG. 14 is a top view of the embodiment of FIG. 13.
Figure 13:
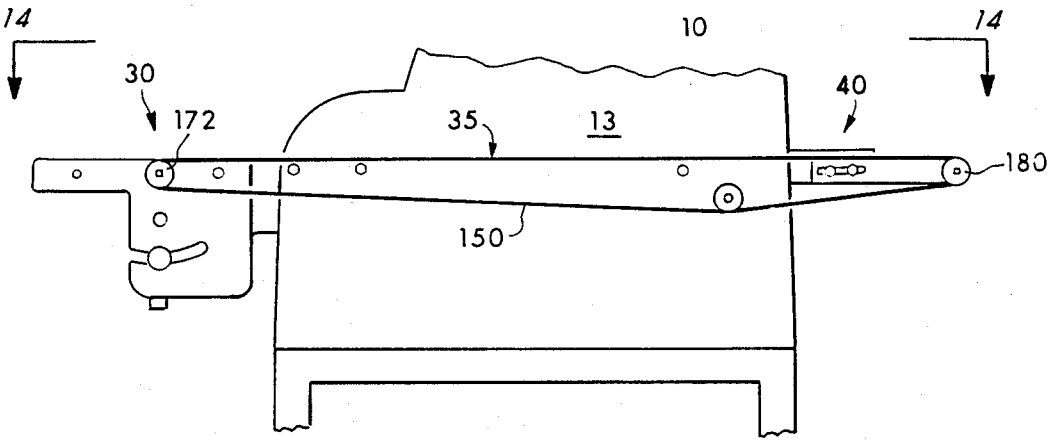
FIG. 13 is an illustration of an alternate embodiment for the power extending means of the present invention.

In FIGS. 13 and 14, an alternate embodiment of the mechanical transfer mechanism 35 of the present invention is set forth. In this embodiment, less drag occurs in the transfer. Pulley 172 in the input module 30 directly drives the belt 150 which engages and drives pulley 180 in the rear tractor module 40. An idler pulley 1300 is provided to maintain the proper tension. In comparison to the embodiment shown in FIG. 1, this embodiment has two less pulleys and two less belts. The approach shown in FIG. 13 is simpler, less costly, and exhibits less drag than the approach of FIG. 1. Both the embodiment of FIG. 1 and FIG. 13, however, fall under the teachings of the present invention and other embodiments, not shown, which performs the mechanical transfer of power from the input module as the paper is pulled through the machine by the printing mechanism 60, 70 could also be designed.

While preferred embodiments of the present invention have been shown, it is to be expressly understood that modifications and changes may be made thereto and that the present invention is set forth in the following claims.

I claim:

1. An apparatus for modifying an individual sheet feed offset duplicator (10) to print impressions on continuous form paper (50), said duplicator having its sheet feed (16) removed from its input (12) and having its sheet delivery (18) removed from its output (14), said duplicator having a rotating printing mechanism (60, 70) for printing said impressions on said continuous form paper and for pulling said continuous form paper through said duplicator, said apparatus comprising:

means (30) connected to said input of said duplicator and engaging said paper for delivering said paper into said duplicator, means (210, 220, 230, 240, 260) in said delivery means cooperative with the rotation of said printing mechanism for providing indexing to said paper as said paper is delivered through said duplicator so that said printed impressions on said paper are registered at a predetermined location, means (282) in said delivery means for selecting said predetermined location while said duplicator is printing said impressions, means (1100) in said delivery means for selectively changing said indexing for different page lengths in said paper, means (40) connected to said output of said duplicator and engaging said paper for maintaining a predetermined amount of tautness on said paper by providing supplementary pulling on said paper as said paper is pulled through said duplicator by said printing mechanism, means (270) in said delivering means engaging said paper for generating power as said paper is pulled through said duplicator, said generating means further providing drag to said paper, and means (35) connected to said duplicator and to said generating means and maintaining means for extending said power from said generating means to said maintaining means to provide the power necessary for said supplementary pull so that said tautness on said paper is created from said drag located at said input and said supplementary pull located at said output as said paper is pulled through said duplicator.

2. The apparatus of claim 1 wherein said continuous form paper has opposing margins (370) with punched holes (380) on the opposing margins and wherein said generating means further comprises:

a pair of elongated tractors (210) engaging the punched holes (380) on the opposing margins (370) of the continuous form paper, said tractors being substantially equal in length to the longitudinal length of a page in said paper so that the margins of said paper including the punched holes are substantially supported by said tractor.

3. The apparatus of claim 2 wherein said generating means further comprises:

a first rectangular plate (912) connected between said pair of elongated tractors and disposed slightly below said continuous form paper for supporting said paper, and a second rectangular plate (1000) connected to the top of said pair of elongated tractors and disposed above said continuous form paper for holding said paper in engagement with said pair of tractors.

4. The apparatus of claim 3 wherein said second rectangular plate has formed openings (910) in a region over the engagement of said tractors with said punched holes of said paper.

5. The apparatus of claim 2 wherein said generating means further comprises:

means (554, 556) operatively connected to said pair of tractors for producing said power as said paper is pulled through said duplicator.

6. The apparatus of claim 1 wherein said providing means comprises:

a cam (526) having an actuating surface (820), said cam being driven to rotate one revolution with each revolution of said printing mechanism, a lever (527, 552, 830) operatively engaging said cam to move in a direction to provide said indexing when said lever engages said actuating surface, a V-shaped key (240) located on said lever, a timing gear (260) engaging said generating means, said timing gear having a V-shaped index opening (250) on the outer surface thereof, said opening being located on said gear at a location wherein when said paper has stopped moving between printing of said impressions, said key with each revolution of said cam fully engages said opening and forces said paper to a predetermination registration (320) position so that the engagement of said V-shaped key with said V-shaped opening at an index point (252) corrects overshoot or undershoot of said paper after the printing of each impression.

7. The apparatus of claim 1 wherein said selecting means comprises:

means (280) engaging said generating means and said providing means for selectively pivoting said providing means about said generating means in a predetermined angle to vary the registration of said impression on said paper.

8. The apparatus of claim 6 wherein said selecting means comprises:

a frame (552) carrying said cam, lever and timing gear, means (280) connected to said frame for selectively pivoting said frame about said generating means in a predetermined angle to vary the registration of said impression on said paper while said impressions are being printed.

9. The apparatus of claim 6 wherein said pivoting means comprises:

means (576, 578) connected to said frame and to said delivering means for selectively releasing said frame from said delivering means, and means (566, 564, 560, 570) connected to said frame and to said delivering means for moving said frame through said predetermined angle.

10. An apparatus for modifying an individual sheet feed offset duplicator (10) to print impressions on continuous form paper (50), said duplicator having its sheet feed (16) removed from its input (12) and having its sheet delivery (18) removed from its output (14), said duplicator having a rotating printing mechanism (60, 70) for printing said impressions on said continuous form paper and for pulling said continuous form paper through said duplicator, said apparatus comprising:

means (30) connected to said input of said duplicator and engaging said paper for delivering said paper into said duplicator, means (40) connected to said output of said duplicator and engaging said paper for maintaining a predetermined amount of tautness on said paper by providing supplementary pulling on said paper as said paper is pulled through said duplicator by said printing mechanism, means (270) in said delivering means and engaging said paper for generating power as said paper is pulled through said duplicator, said generating means further providing drag to said paper, and means (35) connected to said duplicator and to said generating means and maintaining means for extending said power from said generating means to said maintaining means to provide the power necessary for said supplementary pull so that said tautness on said paper is created from said drag located at said input and said supplementary pull located at said output as said paper is pulled through said duplicator.

11. The apparatus of claim 10 wherein said continuous form paper has opposing margins (370) with punched holes (380) on the opposing margins and wherein said generating means further comprises:

a pair of elongated tractors (210) engaging the punched holes (380) on the opposing margins (370) of the continuous form paper, said tractors being substantially equal in length to the longitudinal length of a page in said paper so that the margins of said paper including the punched holes are substantially supported by said tractor.

12. The apparatus of claim 11 wherein said generating means further comprises:

a first rectangular plate (912) connected between said pair of elongated tractors and disposed slightly below said continuous form paper for supporting said paper, and a second rectangular plate (1000) connected to the top of said pair of elongated tractors and disposed above said continuous form paper for holding said paper in engagement with said pair of tractors.

13. The apparatus of claim 12 wherein said second rectangular plate has formed openings (910) in region over the engagement of said tractors with said punched holes of said paper.

14. The apparatus of claim 11 wherein said generating means further comprises:

means (554, 556) operatively connected to said pair of tractors for producing said power as said paper is pulled through said duplicator.

15. An apparatus for modifying an individual sheet feed offset duplicator (10) to print impressions on continuous form paper (50), said duplicator having its sheet feed (16) removed from its input (12) and having its sheet delivery (18) removed from its output (14), said duplicator having a rotating printing mechanism for printing said impressions on said continuous form paper and for pulling said continuous form paper through said duplicator, said apparatus comprising:

a pair of opposing mounting plates (500, 502) mounted to said input of said duplicator, a pair of elongated tractors (210) mounted between said plates for engaging punched holes (360) on margins (370) on opposite sides of said paper, said tractors having a substantial length equal to the longitudinal length of a page in said paper and creating drag to said paper.

means (912, 1000) connected to said tractors for holding said paper in engagement with said pair of tractors, means (554, 556) connected to said tractors for generating power as said paper is pulled through said duplicator, means (552) connected between said plates for angularly moving in a direction perpendicular to the direction containing said plates, a cam (526) having an actuating surface (820), said cam driven to rotate one revolution with each revolution of said printing mechanism, a lever (527, 552, 830) operatively engaging said cam to provide indexing of said paper when said lever operatively engages said actuating surface, a V-shaped key (240) located on said lever, at least one timing gear (260) engaging said generating means, said at least one timing gear having a V-shaped index opening (250) on the outer surface thereof, said opening being located on said at least one gear at a location wherein when said paper has stopped moving between printing of said impressions, said key with each revolution of said cam fully engages said opening and forces said paper to a predetermination registration (320) position so that the engagement of said V-shaped key with said V-shaped opening at an index point (252) corrects overshoot or undershoot of said paper after the printing of each impression, means (280) connected to said moving means and to said generating means for selectively pivoting said moving means about said generating means in a predetermined angle to vary the registration of said impression a predetermined distance on said paper while said impressions are being printed, means (40) connected to said output of said duplicator and engaging said paper for maintaining a predetermined amount of tautness on said paper by providing supplementary pulling on said paper as said paper is pulled through said duplicator by said printing mechanism, and means (35) connected to said duplicator and to said generating means and maintaining means for extending said power from said generating means to said maintaining means to provide the power necessary for said supplementary pull so that said tautness on said paper is created from said drag located at said input and said supplementary pull located at said output as said paper is pulled through said duplicator.

* * * * *